United States Patent [19]

Merl

[11] Patent Number: 4,768,659

[45] Date of Patent: Sep. 6, 1988

[54] MERCHANDISING SHELF SPACER ASSEMBLY

[75] Inventor: Milton J. Merl, New City, N.Y.

[73] Assignee: Marlboro Marketing, Inc., New York, N.Y.

[21] Appl. No.: 57,947

[22] Filed: Jun. 4, 1987

[51] Int. Cl.[4] ..... A47F 7/00

[52] U.S. Cl. ..... 211/59.2; 211/184

[58] Field of Search ..... 211/59.2, 59.4, 90, 211/187, 184, 43, 11; 108/60, 61; 312/42

[56] References Cited

U.S. PATENT DOCUMENTS

| | | | |
|---|---|---|---|
| Re. 30,706 | 8/1981 | Bustos | 211/59.2 |
| 2,915,193 | 12/1959 | Bromberg | 108/61 |
| 3,538,860 | 11/1970 | Fisher | 211/59.2 X |
| 4,488,653 | 12/1984 | Belohin | 211/184 |

FOREIGN PATENT DOCUMENTS

| | | | |
|---|---|---|---|
| 1050490 | 3/1979 | Canada | 211/184 |

*Primary Examiner*—Ramon S. Britts
*Assistant Examiner*—Sarah A. Lechok Eley
*Attorney, Agent, or Firm*—Henry Sternberg; Bert J. Lewen

[57] ABSTRACT

Merchandising unit for stacked row gravity feed consumer product display and self service access, including a merchandise shelf having a rearward product display top surface and a forward product access top surface disposed in angularly offset relation to the display surface, the shelf being mountable horizontally on a support such that the display surface extends angularly forwardly and downwardly and the access surface extends angularly forwardly and upwardly for location of a supply of manually removable consumer products in successively stacked row gravity feed condition on the access surface and upwardly along the display surface, and a spacer assembly comprising bearing regions for positioning the spacer assembly on the shelf, upwardly facing contact surface regions positioned in upwardly spaced relation to the access surface for engaging the underside of an adjacent consumer product thereabove, and a cavity formation interposed in downwardly spaced relation to the contact surface regions and in upwardly spaced relation to the access surface and defining an open insertion cavity of finger accommodating size, for thereby maintaining such product in raised condition relative to the access surface and simultaneously providing a corresponding finger accommodating open space between the product and access surface to facilitate manual removal of the product from the shelf.

12 Claims, 1 Drawing Sheet

MERCHANDISING SHELF SPACER ASSEMBLY

FIELD AND BACKGROUND OF THE INVENTION

The present invention relates to a spacer assembly for a merchandise shelf, and more particularly to a merchandise unit for stacked row gravity feed consumer product display and self service access, in which the spacer assembly serves to maintain the product stack in raised condition relative to the usual access surface of the shelf and simultaneously to provide a finger insertion space between the product and access surface to facilitate manual removal of the product from the shelf.

Currently, many drug stores, supermarkets and similar consumer serving business establishments utilize so called down angled or slanted shelving for stacking hand size boxed and bottled consumer products, especially in their health and beauty aids sections, to exploit the benefits thereby offered of better visibility, increased facings or display items per available unit area, reduced product inventory and improved overall presentation. To this end, contemporary store shelving manufacturers have developed a line of angled shelving with deep front lips that fit onto their merchandising units such as standard three, four, five and six foot on center by multiple height gondolas, or the like type display and self service systems.

By using this type of slanted shelving, any number of packaged consumer products, whether they be boxed or bottled, can be positioned in a semi-horizontal format at or below customer eye level, presenting good product visibility in a neat and orderly fashion. A key benefit of this type of configuration is due to the angle of slant of such shelving in the merchandising unit. Specifically, as one product from the lower end of the stack on the shelf is removed, another product slides down, by gravity, thereby replacing it. This presents to the customer a front-faced, always full-appearing, display while lowering labor costs for the retailer and avoiding the need for large amounts of inventory in order to accomplish a full and well stocked look.

However, a fundamental problem with the existing merchandise units is that it is usually difficult for the self service consumer to remove the bottom product from the stack on the slanted shelf, because gravity forces it and the products above it downwardly and forwardly flush against the shelf lip forming the access surface, so as to leave no finger space for enabling the bottom product of the deadweight stack to be lifted out.

Thus, there is a real need for providing an improvement in the existing merchandising systems utilizing slanted shelving of the described type, to overcome this very practical problem.

SUMMARY OF THE INVENTION

It is among the objects and advantages of the present invention to overcome the drawbacks and deficiencies of the prior art, and to provide an arrangement of merchandising unit parts by which fingergrips or fingerspacings are created between the stacked consumer products and the lower edge or lip of the slanted display shelf, to aid in consumer product removal and expedite consumer shopping.

It is among the additional objects and advantages of the present invention to provide a spacer assembly for positioning on such a slanted merchandise shelf, having means for maintaining such product in raised condition relative to the front access surface of the shelf and for simultaneously providing a corresponding finger accommodating open space between the product and access surface to facilitate manual removal of the product from the shelf by the self service shopper.

It is among the further objects and advantages of the present invention to provide a spacer assembly of the stated type which is comparatively simple and inexpensive in construction, readily fabricated from widely available materials, usable as a modification on and in combination with existing slanted merchandise shelf systems and installations, and robust and long wearing in use.

According to the present invention, a spacer assembly is provided which is adapted for positioning on a merchandise shelf of a merchandising unit for stacked row gravity feed consumer product display and self service access. The merchandising shelf is generally of the type having a rearward product display top surface, a forward product access top surface disposed in angularly offset relation to the display surface, and mounting means adapted for mounting the shelf generally horizontally on a support, such that the display surface extends angularly forwardly and downwardly and the access surface extends angularly forwardly and upwardly for location of a supply of manually removable consumer products in successively stacked row gravity feed condition on the access surface and upwardly along the display surface.

The spacer assembly comprises bearing means for positioning the spacer assembly on the merchandise shelf, upwardly facing contact surface means adapted for positioning in upwardly spaced relation to the access surface of the shelf for engaging the underside of an adjacent consumer product thereabove, and cavity formation means interposed in downwardly spaced relation to the contact surface means and adapted for positioning in upwardly spaced relation to the access surface. The cavity formation means specifically defines at least one open insertion cavity of finger accommodating size.

This arrangement effectively serves to maintain the product in raised condition relative to the access surface and simultaneously to provide a corresponding finger accommodating open space between the product and the access surface to facilitate manual removal of the product from the shelf.

More specifically, the spacer assembly comprises at least one spacer member having a downwardly facing bearing surface for engaging the adjacent portion of the access surface, an upwardly facing contact surface for engaging the underside of an adjacent consumer product thereabove, and a cavity formation interposed between the contact surface and bearing surface and defining within its perimetric confines at least a portion of at least one open insertion cavity of finger accommodating size.

In accordance with one embodiment herein, the spacer member is laterally elongated for extending laterally along the shelf, and the cavity formation includes a plurality of side by side finger accommodating open insertion cavities arranged laterally along the spacer member. Favorably, the cavities may be in the form of open grooves upwardly communicating with the contact surface, and the contact surface correspondingly may be a discontinuous surface interrupted by the grooves to define side by side contact surface regions spaced apart at a selective finger size interval for permitting a pair of adjacent coacting contact surface regions to engage the underside of an adjacent consumer product thereabove having a lateral width exceeding such finger size interval.

In accordance with another embodiment herein, the spacer assembly comprises a pair of spacer members in the form of adjacent coacting vertically elongated consumer product dividers arranged for positioning generally vertically on the access surface and in selectively laterally spaced apart relation to each other for accommodating therebetween a corresponding lateral width consumer product supply in successively stacked row gravity feed condition. The dividers each have a downwardly facing bearing surface for engaging the adjacent portion of the access surface, a lateral extension facing the other divider, and including an upwardly facing contact surface positioned for coactively engaging the underside of an adjacent consumer product thereabove, and a counterpart cavity formation interposed between the contact surface and bearing surface and defining a corresponding portion of an open insertion cavity, such that the counterpart cavity formations of the pair of dividers together define a common composite open insertion cavity of finger accommodating size.

In accordance with a preferred feature of this second embodiment, at least one of the dividers is in the form of a bilateral extension divider, having a bilaterally opposed pair of said extensions, each correspondingly including a said contact surface and providing a said counterpart cavity formation.

BRIEF DESCRIPTION OF THE DRAWINGS

Other and further objects and advantages of the present invention will become apparent from the within specification and accompanying drawings, in which.

DESCRIPTION OF THE PREFERRED EMBODIMENTS

Figures 1, 2, 3, 4:
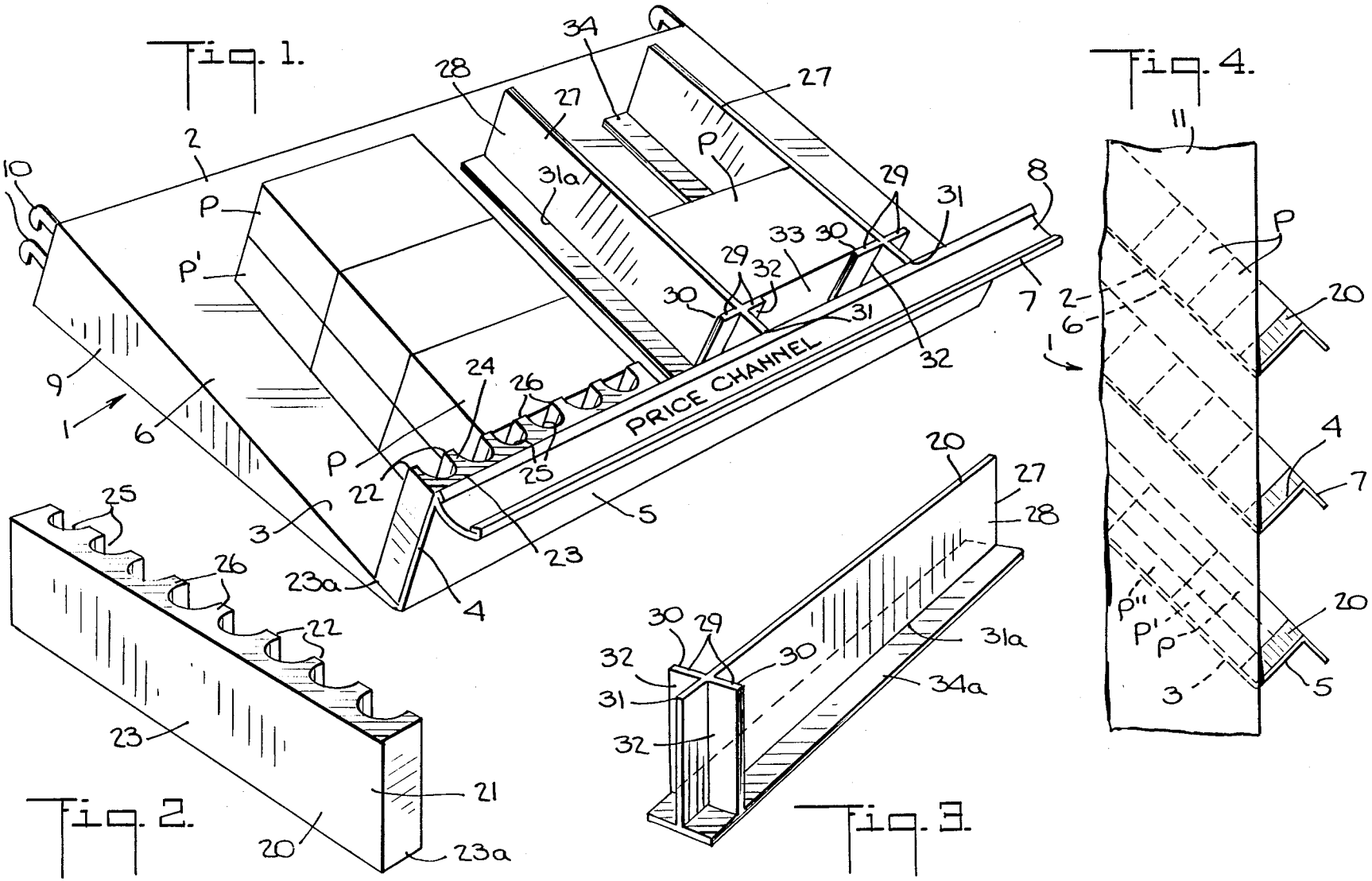
FIG. 1 is a schematic perspective view of a conventional slanted merchandise shelf modified by the inclusion therewith of one or both of the two separate spacer assembly embodiments according to the present invention shown disposed on the shelf.
FIG. 2 is a schematic perspective view of a spacer member corresponding to one of the two embodiments shown in FIG. 1.
FIG. 3 is a schematic perspective view of one of the pair of spacer members collectively constituting the other of the two embodiments shown in FIG. 1.
FIG. 4 is schematic partial side view of a merchandise unit containing a series of such slanted merchandise shelves, and illustrating the positional relationship of supplies of stacked rows of consumer products to the pertinent parts of the spacer assembly system contemplated by the present invention.

Referring to the drawings, and initially to FIGS. 1 and 4, a merchandising unit 1 is shown, which includes an outwardly or forwardly slanted merchandise shelf 2 having a rearward product display top surface 3 and a forward product access top surface 4. Access surface 4 is disposed in angularly offset relation to display surface 3, and is located in the outer or forward wall 5 which forms a lower end flange or lip continuation on the main inner or rearward wall 6 of shelf 2, e.g. at a right angle thereto, thus forming a stop whereby to keep the inclined stack of consumer products P intact as a supply and display, and prevent the products from sliding off the so slanted shelf. A front apron 7 depends from the front edge of forward wall 5 and contains a channel 8 for receiving indicia thereat such as price and/or other information.

The lateral sides of shelf 2 may be provided with bracing portions 9,9, one of which is shown, and at the rear end portion of each of which may be provided mounting means, such as conventional coacting mounting lugs 10 adapted to engage conventional lug locking means or the like (not shown) in a separate support 11 (see FIG. 4), for mounting the shelf generally horizontally on the support such that display surface 3 extends angularly forwardly and downwardly and access surface 4 extends angularly forwardly and upwardly as shown.

Merchandise shelf 2, including its surrounding structure so far described, is conventional, and such provides a slanted shelf environment permitting location of a like slanted supply of manually removable, generally hand manipulatable, consumer products P in successively stacked row gravity feed condition directly on access surface 4 and upwardly and rearwardly along the common extent of display surface 3. Products P may be of any common size per stack set, and are usually successively stacked in one or more front to back rows P, P', P'', etc. (cf. FIG. 4), and/or in one or more side by side rows, and may constitute boxed or bottled merchandise items or the like, i.e. of a common size per front to back set of rows.

As shown in FIG. 4, the normal arrangement spatial confines are such that while the display surface 3 of a particular shelf 2 presents a given stack to anyone viewing the mechandise unit 1, the access surface 4 retains the cumulative deadweight of the stack in a manner making it difficult to remove the bottom product from the stack which is closest to the facing customer and logically the product meant to be next taken.

By way of the present invention, the above conventional arrangement is advantageously modified by the inclusion therein of a spacer assembly 20, two forms of which are shown.

According to one such form, as shown more fully in FIG. 2, the spacer assembly 20 comprises a spacer member 21 which includes an upwardly facing contact surface 22 for engaging the underside of an adjacent consumer product P thereabove, a downwardly facing bearing surface 23 for engaging the adjacent portion of access surface 4, and conveniently a corresponding rearwardly facing bearing surface 23*a* for engaging the adjacent portion of display surface 3. Significantly, a cavity formation 24 is interposed between contact surface 22 and bearing surface 23. Cavity formation 24 defines within its perimetric confines, as well as within the apparent or composite perimetric confines of the spacer member 21 itself, at least a portion of at least one open insertion cavity 25 of finger accommodating size.

In particular, as shown in FIGS. 1 and 2, spacer member 21 is laterally elongated for extending laterally along a selective lateral extent of shelf 2, and cavity formation 24 favorably includes a plurality of side by side finger accommodating open insertion cavities 25, arranged laterally along spacer member 21. It will be seen that the cavities 25 are in the form of individual open grooves, extending generally crosswise or transversely of the lateral direction of shelf 2, and upwardly communicating with contact surface 22.

Thus, contact surface 22 is provided as a discontinuous surface interrupted by the grooves or cavities 25 to define corresponding side by side contact surface regions 26 spaced apart at a selective finger size interval for permitting a pair of adjacent coacting regions to engage the underside of an adjacent consumer product P thereabove having a lateral product width exceeding such finger size interval (see FIG. 1).

According to a second such form, as shown in part more fully in FIG. 3, the spacer assembly 20 comprises a pair of spacer members 27,27, in the form of adjacent coacting vertically elongated consumer product dividers 28,28, which are arranged as transverse walls for positioning generally vertically on access surface 4 and in selectively, e.g. adjustably, laterally spaced apart relation to each other, for accommodating therebetween a corresponding lateral width consumer product supply in successively stacked row gravity feed condition (see FIG. 1). More specifically, dividers 28,28 each have a counterpart lateral extension 29 facing the other, including a counterpart upwardly facing contact surface 30 positioned for coactively engaging the underside of an adjacent consumer product P thereabove, plus a downwardly facing bearing surface 31 for engaging the adjacent portion of access surface 4, and conveniently a corresponding rearwardly facing bearing surface 31*a* for engaging the adjacent portion of display surface 3. In this case, a counterpart cavity formation 32 is interposed between contact surface 30 and bearing surface 31 of each divider 28.

Each counterpart cavity formation 32 defines a corresponding portion of an open cavity, such that the facing counterpart cavity formations 32,32 of a pair of dividers 28,28 together define a common composite open insertion cavity 33 of finger accommodating size (see FIG. 1).

The dividers 28,28 may be optionally provided with a rearward bilateral seating flange 34 as shown in FIG. 3, e.g. as a bilateral continuation of rearward bearing surface 31*a*, to facilitate stabilized disposition of the elongated portion thereof in seating contact with display surface 3 of shelf 2 in the conventional manner.

Preferably, at least one of the dividers 28,28 is in the form of a bilateral extension divider, i.e. having a bilaterally opposed pair of counterpart lateral extensions 29,29, each correspondingly including a counterpart contact surface 30 and providing such a counterpart cavity formation 32 (see FIG. 3).

Thus, according to this second form of the spacer assembly 20, the same comprises a pair of spacer members 27,27, each of which includes an upwardly facing contact surface 30 for engaging the underside of an adjacent consumer product P thereabove, a downwardly facing bearing surface 31 for engaging the adjacent portion of the access surface 4, and a cavity formation 32 interposed between the contact surface 30 and bearing surface 31. Cavity formation 32 likewise defines within its perimetric confines, and within the apparent or composite perimetric confines of the spacer member 27 itself, at least a portion of at least one open insertion cavity 33 of finger accommodating size.

By way of the present invention, therefore, a spacer assembly is provided which is adapted for positioning on a merchandise shelf of a merchandising unit for stacked row gravity feed consumer product display and self service access, the merchandising shelf being of the type having a rearward product display top surface, a forward product access top surface disposed in angularly offset relation to the display surface, and mounting means adapted for mounting the shelf generally horizontally on a support, such that the display surface extends angularly forwardly and downwardly and the access surface extends angularly forwardly and upwardly for location of a supply of manually removable consumer products in successively stacked row gravity feed condition on the access surface and upwardly along the display surface.

As is clear from FIGS. 1–4, the spacer assembly comprises bearing means, such as downwardly facing bearing surface means and rearwardly facing bearing surface means, for positioning the spacer assembly on such a merchandise shelf, upwardly facing contact surface means adapted for positioning in upwardly spaced relation to the access surface of the shelf for engaging the underside of an adjacent consumer product thereabove, and cavity formation means interposed in downwardly spaced relation to the contact surface means and adapted for positioning in upwardly spaced relation to the access surface and defining at least a portion of at least one open insertion cavity of finger accommodating size, for thereby maintaining the product in raised condition relative to the access surface and simultaneously providing a corresponding finger accommodating open space between the product and access surface to facilitate manual removal of the product from the shelf.

In its simplest terms, the spacer assembly of the present invention contemplates, per the first noted embodiment (FIG. 2), a selectively shaped piece of material, produced by any suitable manufacturing process, such as thermal forming, injection molding, casting, metal stamping, wood molding, or the like, which is placed as a spacer between the product and the bottom edge of the shelf. The configuration of this spacer is such that it consists preferably of more or less peaks and valleys, the cross section of each of which is not particularly critical, so long as there is enough space in the valleys or cavities to allow for a finger to slip in between the shelf and stacked product and the distance between peaks is close enough so that two adjacent peaks will always contact one surface or side area portion of an individual product. These pieces, i.e. spacer members, may be manufactured in any desired length, e.g. preferably in inventories of three, four, five, etc. matching shelf lengths, and correspondingly in a series of desired heights to match the depth of the various shelving front lips, e.g. of the type presently in existence.

As to the second noted embodiment of the present invention (FIG. 3), it should be pointed out that in most instances retailers choose to use dividers between various product rows in the instant type shelving configurations, because without them products tend to shift, and therefore do not hold the desired planogram effect. More important, when the products do shift, they often objectionably catch onto each other. Considering the prevalent use of dividers, the second noted embodiment offers a unique design for achieving the same finger spacing solution as in the first embodiment.

In its like simplest terms, the spacer assembly of the second embodiment of the present invention contemplates the creation, i.e. by analogous manufacturing technique, of what amounts to a "bump", i.e. a rib, ridge or other boss or protuberance on one side, or preferably on both sides, of each divider of an intended coacting pair. That "bump" or the like is located at a raised level relative to the access surface of the shelf and/or relative to the downwardly facing bearing surface of the divider, so as to provide a vertical gap or distance therebetween approximately corresponding to the thickness of a finger, and laterally extends from the given divider toward the other a short distance, i.e. from the side, which is sufficient to engage a lateral edge portion of the underside of an adjacent product thereabove, yet which is preferably less than a lateral or horizontal distance approximately corresponding to the thickness of a finger, but in any case is such that the collective lateral extension distance as compositely provided by a pair of coacting dividers in selectively spaced apart relation will still provide an upwardly open intervening lateral gap therebetween approximately corresponding to the thickness of a finger for exposing the adjacent product underside to finger access facilitating product removal. In this way, as the products slide down between adjacent dividers, such coacting "bumps" or the like will stop the lowermost product in the stack from contacting the bottom lip area at the access surface, and simultaneously effectively create a finger grip opening thereat.

It will be appreciated that the foregoing specification and accompanying drawings are set forth by way of illustration and not limitation, and that various modifications and changes may be made therein without departing from the spirit and scope of the present invention which is to be limited solely by the scope of the appended claims.

What is claimed is:

1. Merchandising unit for stacked row gravity feed consumer product display and self service access, which comprises a merchandise shelf having a rearward product display top surface, a forward product access top surface disposed in angularly offset relation to the display surface, and mounting means adapted for mounting the shelf generally horizontally on a support such that the display surface extends angularly forwardly and downwardly and the access surface extends angularly forwardly and upwardly for location of a supply of manually removable consumer products in successively stacked row gravity feed condition on the access surface and upwardly along the display surface, and a separate spacer assembly comprising bearing means for positioning the spacer assembly on the shelf, upwardly facing contact surface means positioned in upwardly spaced relation to the access surface for engaging the underside of an adjacent consumer product thereabove, and cavity formation means interposed in downwardly spaced relation to the contact surface means and in upwardly spaced relation to the access surface and defining within its perimetric confines as well as within the composite perimetric confines of the spacer assembly at least one open insertion cavity of finger accommodating size, for thereby maintaining such product in raised condition relative to the access surface and simultaneously providing a corresponding finger accommodating open space between the product and the access surface to facilitate manual removal of the product from the shelf.

2. Unit of claim 1 wherein the spacer assembly comprises at least one spacer member having a downwardly facing bearing surface for engaging the adjacent portion of the access surface, an upwardly facing contact surface for engaging the underside of an adjacent consumer product thereabove, and a cavity formation interposed between the contact surface and bearing surface and defining within its perimetric confines at least a portion of at least one open insertion cavity of finger accommodating size.

3. Unit of claim 2 wherein the spacer member is laterally elongated for extending laterally along the shelf, and the cavity formation includes a plurality of side by side finger accommodating open insertion cavities arranged laterally along the spacer member.

4. Unit of claim 3 wherein the cavities are in the form of open grooves upwardly communicating with the contact surface, and the contact surface is a discontinuous surface interrupted by the grooves to define side by side contact surface regions spaced apart at a selective finger size interval for permitting a pair of adjacent coacting contact surface regions to engage the underside of an adjacent consumer product thereabove having a lateral width exceeding such finger size interval.

5. Unit of claim 2 wherein the spacer assembly comprises a pair of spacer members in the form of adjacent coacting vertically elongated consumer product dividers arranged for positioning generally vertically on the access surface and in selectively laterally spaced apart relation to each other for accommodating therebetween a corresponding lateral width consumer product supply in successively stacked row gravity feed condition, the dividers each having a downwardly facing bearing surface for engaging the adjacent portion of the access surface, a lateral extension facing the other divider, and including an upwardly facing contact surface positioned for coactively engaging the underside of an adjacent consumer product thereabove, and a counterpart cavity formation interposed between the contact surface and bearing surface and defining a corresponding portion of an open insertion cavity, such that the counterpart cavity formations of the pair of dividers together define a common composite open insertion cavity of finger accommodating size.

6. Unit of claim 5 wherein at least one of the dividers is in the form of a bilateral extension divider, having a bilaterally opposed pair of said extensions, each correspondingly including a said contact surface and providing a said counterpart cavity formation.

7. Separate spacer assembly adapted for positioning on a merchandise shelf of a merchandising unit for stacked row gravity feed consumer product display and self service access, such merchandising shelf being of the type having a rearward product display top surface, a forward product access top surface disposed in angularly offset relation to the display surface, and mounting means adapted for mounting the shelf generally horizontally on a support such that the display surface extends angularly forwardly and downwardly and the access surface extends angularly forwardly and upwardly for location of a supply of manually removable consumer products in successively stacked row gravity feed condition on the access surface and upwardly along the display surface, the spacer assembly comprising bearing means for positioning the spacer assembly on such a merchandise shelf, upwardly facing contact surface means adapted for positioning in upwardly spaced relation to the access surface of such shelf for engaging the underside of an adjacent consumer product thereabove, and cavity formation means interposed in downwardly spaced relation to the contact surface means and adapted for positioning in upwardly spaced relation to the access surface and defining within its perimetric confines as well as within the composite perimetric confines of the spacer assembly at least one open insertion cavity of finger accommodating size, for thereby maintaining such product in raised condition relative to the access surface and simultaneously providing a corresponding finger accommodating open space between the product and the access surface to facilitate manual removal of the product from the shelf.

8. Assembly of claim 7 wherein the spacer assembly comprises at least one spacer member having a downwardly facing bearing surface for engaging the adjacent portion of the access surface, an upwardly facing contact surface for engaging the underside of an adjacent consumer product thereabove, and a cavity formation interposed between the contact surface and bearing surface and defining within its perimetric confines at least a portion of at least one open insertion cavity of finger accommodating size.

9. Assembly of claim 8 wherein the spacer member is laterally elongated for extending laterally along the shelf, and the cavity formation includes a plurality of side by side finger accommodating open insertion cavities arranged laterally along the spacer member.

10. Assembly of claim 9 wherein the cavities are in the form of open grooves upwardly communicating with the contact surface, and the contact surface is a discontinuous surface interrupted by the grooves to define side by side contact surface regions spaced apart at a selective finger size interval for permitting a pair of adjacent coacting contact surface regions to engage the underside of an adjacent consumer product thereabove having a lateral width exceeding such finger size interval.

11. Assembly of claim 8 wherein the spacer assembly comprises a pair of spacer members in the form of adjacent coacting vertically elongated consumer product dividers arranged for positioning generally vertically on the access surface and in selectively laterally spaced apart relation to each other for accommodating therebetween a corresponding lateral width consumer product supply in successively stacked row gravity feed condition, the dividers each having a downwardly facing bearing surface for engaging the adjacent portion of the access surface, a lateral extension facing the other divider, and including an upwardly facing contact surface positioned for coactively engaging the underside of an adjacent consumer product thereabove, and a counterpart cavity formation interposed between the contact surface and bearing surface and defining a corresponding portion of an open insertion cavity, such that the counterpart cavity formations of the pair of dividers together define a common composite open insertion cavity of finger accommodating size.

12. Assembly of claim 11 wherein at least one of the dividers is in the form of a bilateral extension divider, having a bilaterally opposed pair of said extensions, each correspondingly including a said contact surface and providing a said counterpart cavity formation.

* * * * *